US005167576A

United States Patent [19]

Hoek

[11] Patent Number: 5,167,576

[45] Date of Patent: Dec. 1, 1992

[54] LIGHTING-FITTING COMPRISING A FILTER DEVICE TO REMOVE SMOKE COMPONENTS OF CIGARS AND CIGARETTES

[76] Inventor: Wilhelmus A. H. Hoek, Florastraat 217, 4613 CZ IBergen Op Zoom, Netherlands

[21] Appl. No.: 611,308

[22] Filed: Nov. 9, 1990

[30] Foreign Application Priority Data

Nov. 9, 1989 [NL] Netherlands ..... 8902777

[51] Int. Cl.[5] ..... F24F 7/007

[52] U.S. Cl. ..... 454/230; 55/467; 454/354

[58] Field of Search ..... 55/316, 385.2, 467, 55/471; 98/31.5, 31.6, 40.07, 40.08; 362/149, 294

[56] References Cited

U.S. PATENT DOCUMENTS

| | | | |
|---|---|---|---|
| 3,097,287 | 7/1963 | Knoll et al. | 362/149 X |
| 3,124,054 | 3/1964 | Sherron | 98/40.07 X |
| 3,309,502 | 3/1967 | Witherspoon, Jr. | 98/31.5 X |
| 4,681,024 | 7/1987 | Ivey | 98/31.6 X |
| 4,711,161 | 12/1987 | Swin, Sr. et al. | 98/31.5 |

FOREIGN PATENT DOCUMENTS

| | | | |
|---|---|---|---|
| 1-168316 | 7/1989 | Japan | 55/467 |

*Primary Examiner*—Harold Joyce

*Attorney, Agent, or Firm*—Bachman & LaPointe

[57] ABSTRACT

In a lighting-fitting comprising a socket-structure for an electrical lamp and a filter device to remove smoke components of cigars and cigarettes, which device is provided with an electrical blower (6) and at least one smoke filter (3,4), the socket-structure is housed within a first hood (1), which is placed within a larger second hood (2), such that a space between the first hood and second hood forming a smoke channel (7, 7') extending to the filter device is defined. Furthermore, the socket-structure is designed for at least one TL-tube, while the smoke filters (3,4) are located within the second hood (2) over the top of the first hood (1), and the first hood (1) can easily be assembled and disassembled relative to the second hood (2). In a preferred embodiment, the space between the first hood (1) and the second hood (2) defines an exhaust channel (12) extending from the filter device, to exhaust filtered air. Furthermore, the feeding openings (8, 8') and the exhaust openings (13) of the smoke channel (7, 7') at the exhaust channel (12) respectively extend in lengthwise direction on both sides of the first hood (1). The feeding openings (8, 8') and the exhaust openings (13) can be defined by a slit with varying width between the first hood (1) and the second hood (2). To easily assemble and disassemble the first hood (1) relative to the second hood (2), the first (1) can be pivotably mounted within the second hood (2).

6 Claims, 3 Drawing Sheets

LIGHTING-FITTING COMPRISING A FILTER DEVICE TO REMOVE SMOKE COMPONENTS OF CIGARS AND CIGARETTES

BACKGROUND OF THE INVENTION

This invention relates to a lighting-fitting comprising a socket structure for an electrical lamp and a filter device to remove smoke components of cigars and cigarettes provided with an electrical blower and at least one smoke filter, said socket structure being housed within a first hood, which is placed within a larger second hood such that a space between said first and said second hood forming a smoke channel leading to the filter device is defined.

Smoke of cigars and cigarettes has become unpleasant for an increasing number of people. Smokers assume prohibition of smoking often as an unacceptable intrusion on their freedom. There is a need for solving this problem.

The combination of lighting and smoke filtering results in some important advantages. The electrical power supply for a lighting-fitting is nearly almost available in rooms and audiences, so there won't be a problem to connect the blower to the electrical power system. Moreover, lighting-fittings are often found in places where people gather and thus could be irritated by smoke.

NL-A-8800812 describes a device of the above-mentioned type. This known device of the combination of a lighting-fitting and a filtering device has disadvantages. More precise, this device cannot readily be used in rooms, such as conference rooms, in which the lighting-fittings are incorporated in the sealing. In those spaces which are used intensively and in which people are often smoking, it can be expected that the filter components must be replaced often. This replacement has to be carried out as efficiently as possible. Also, these spaces are to a large extent illuminated by so-called TL-lighting. The prior art device shows a general combination of a lighting-fitting comprising a filter device to remove smoke components of cigars and cigarettes, and does not show the specific provisions needed to solve the above-mentioned problems.

SUMMARY OF THE INVENTION

It is an object of the invention to modify the present device such that this can effectively be incorporated in ceilings of rooms which are illuminated by TL-lighting to a large extent, whereby the filter can be replaced efficiently.

According to the present invention, the lighting-fitting of the above-mentioned type is characterized in that the socket-structure is designed for at least one TL-tube, that the smoke filters are located in the second hood over the top of the first hood, and that the first hood can easily be assembled and disassembled relative to the second hood. This assures that the filters are readily accessible for efficient replacement and that the device is readily available for conference rooms etc..

According to a preferred embodiment of the invention, the space between said first and said second hood defines an exhaust channel extending from the filter device, to exhaust filtered air. This feature has the advantage that filtered air can easily be led back into the room below the lighting-fitting, without the need for additional exhaust openings in e.g. the ceiling.

According to another embodiment of the invention, the feeding openings and the exhaust openings of the smoke channel and the exhaust channel respectively extend in lengthwise direction on both sides of the first hood. This assures removal and re-introduction of air over a large extend of the ceiling.

According to yet another embodiment of the invention, said feeding openings and/or said exhaust openings are defined by a slit with varying width between the first and the second hood. This assures uniform air-suction and air-exhaustion over the length of the openings. The exact shape of the slit will, among other things, be defined by the position and the shape of the openings through which cleaned air comes out of the fitting, and the shape and the type of filters used.

For compactness of the device and for easy accessibility, it is preferred that the electrical blower is mounted within the space between the first and the second hood.

A convenient embodiment of the lighting-fitting according to the invention can easily be placed on sections used for the so-called "system" ceiling constructions. A fitting of this type can be suitable both to build in as well as to build up.

To replace the filters and/or the blower efficiently, it is preferred to design the hood that comprises the socket such that this can easily be assembled and disassembled. This can for instance be obtained by connecting this hood hingedly to the larger hood, or to allow that this hood can be lowered relative to the larger hood with the aid of pulleys. Of course, several other solutions are possible. It is also preferred to divide the filter into several components that can be removed individually.

Furthermore, the lighting-fitting can be provided with at least one switch to switch on or off the power for the blower and for the socket or any other lamp independently. This feature enhances the usefulness of the device. To control the amount of air that is filtered within a period of time, the switch of the blower preferably comprises several positions correlating with a different number of revolutions.

In the following, the present invention will be described in details with reference to the drawings schematically showing an embodiment.

DETAILED DESCRIPTION

Figure 1:
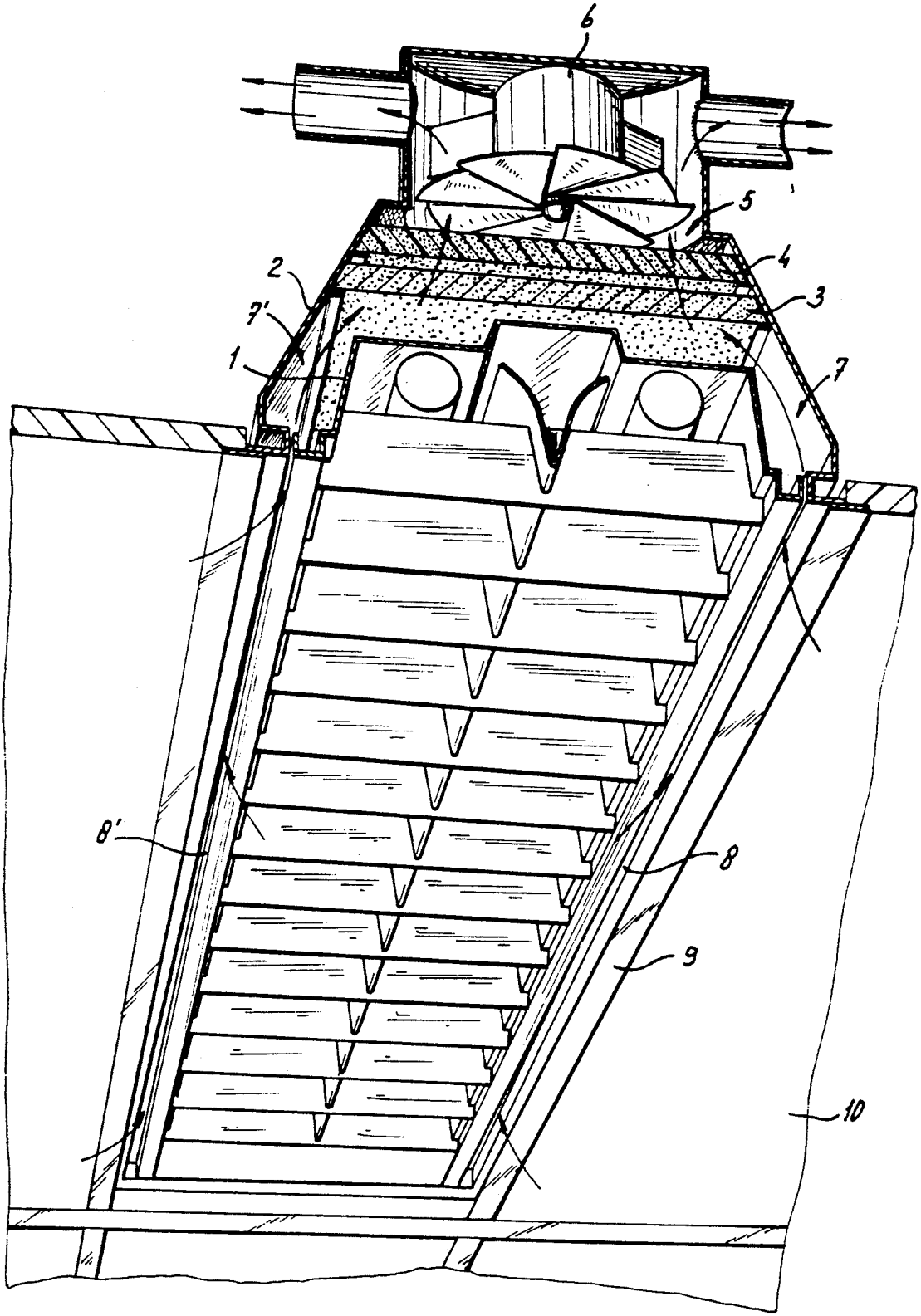
FIG. 1 shows a perspective view of a preferred embodiment of the lighting-fitting according to the present invention.

FIG. 1 shows how a first hood 1 comprising two TL-tubes, is mounted within a larger second hood 2. A filter 3 for the removal of dust-particles and a carbon filter 4 are provided within the second hood 2 over the top of the first hood 1. The filters 3, 4 can in lengthwise direction of the second hood 2 exist of e.g. three elements with the same dimensions, such that replacement of the filters 3, 4 is easy. The filters 3, 4 can be fixed within the second hood by e.g. Velcro-tape. It should also be possible to place the individual components of filters 3, 4 into a simple frame, which can be suspended in the second hood 2 by e.g. resilient palls. It is evident, that the filters 3, 4 can also be made from other materials, and can be e.g. a resin filter, and/or an electronic filter cell, or an ionisation filter, etc.

In the embodiment shown in FIG. 1, the suck-out opening 5 is provided in the top of the second hood 2 halfway the length of it. The blower 6 sucks the air through this opening 5.

The space 7, 7' between the hoods 1, 2 forms a smoke channel which extends to the filter device. The openings 8, 8' of the smoke channel extend in lengthwise direction of the first hood 1 on both sides of it. Depending for instance on the shape and the type of the filters 3, 4 and the position of the suck-out opening 5, the openings 8, 8' can be defined by a slit between the first 1 and the second hood 2 with varying width. The shape of this slit assures an even suck-out over the length of the lighting-fitting. In the embodiment shown, the openings 8, 8' are shaped by a slit with the smallest width in the neighbourhood of the suck-out opening 5, while the width increases towards the ends. Other slit shapes can be necessary when for instance the position of the suck-out opening is changed, or if for instance the second hood 2 is provided with several suck-out openings.

"9" refers to the supporting sections of the ceiling panels 10. The edges of the second hood 2 are supported by these ceiling sections 9 according to this embodiment.

The air to be cleaned from smoke components of cigars and cigarettes, that is located under the sealing, flows by the activated blower 6 via the openings 8, 8' into the smoke channels 7, 7'. The air is then cleaned in the filters 3, 4, after which the cleaned air is led back to the space under the ceiling, e.g. by a system of channels.

It is otherwise possible, to locate the blower somewhere else, and it is even possible, that the blower is serving several lighting-fittings according to the present invention, e.g. via a system of channels.

Figure 2:
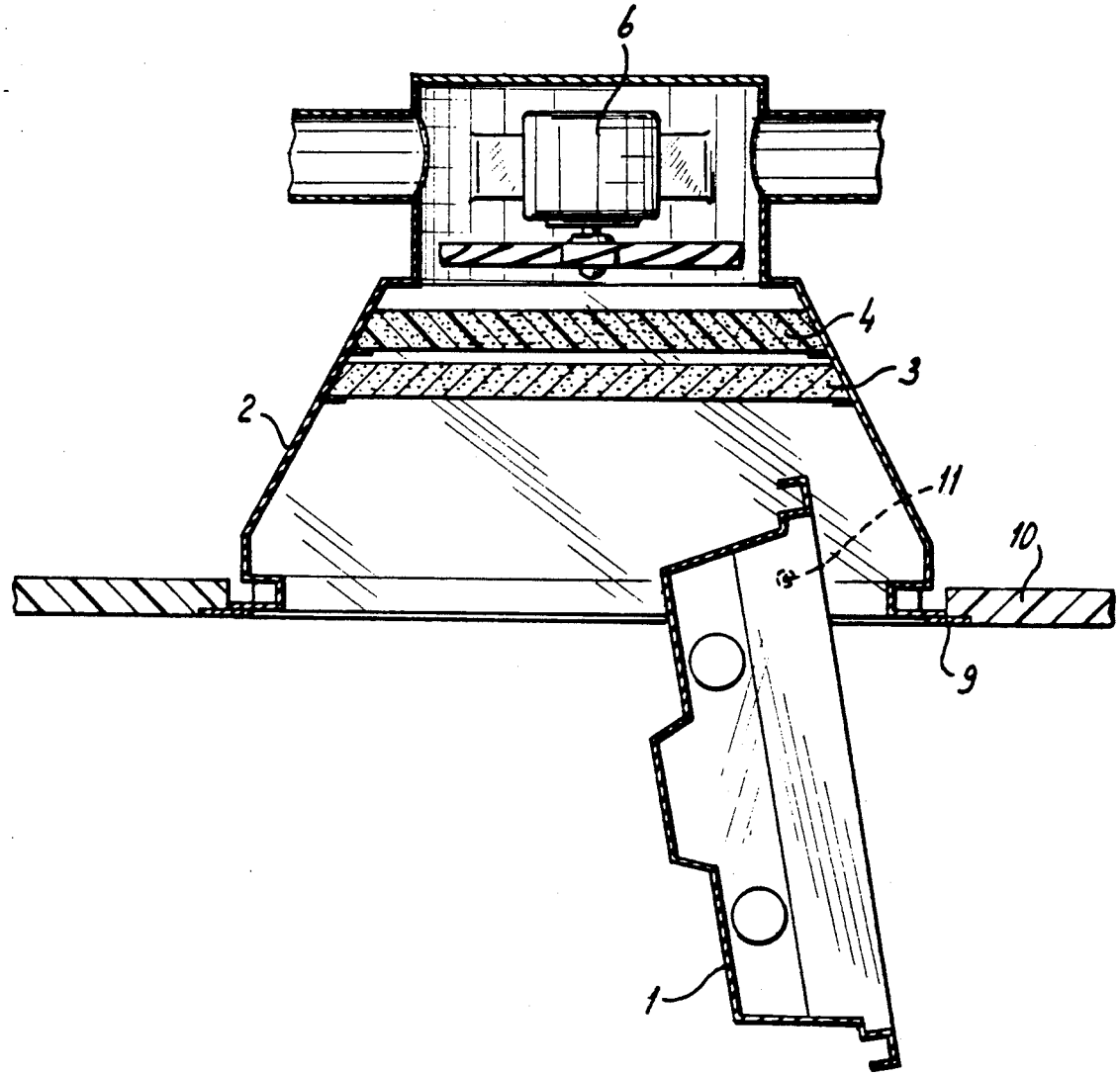
FIG. 2 shows a cross-sectional view of the lighting-fitting of FIG. 1 during replacement of the filters.

In FIG. 2 the first hood 1 is connected to the second hood 2 such that the first hood 1 can pivot relative to the second hood 2. Here, the first hood 1 pivots around support 11. Because of this easy assembling and disassembling of this first hood 1, the space with the filters 3, 4 is quickly and easily accessible. This increases the effectiveness of the replacement of the filters and possible other maintenance. It is also possible to realize this provision by designing the device such that the first hood 1 can be lowered relative to the second hood 2 with the aid of pulleys. This also provides convenient accessibility of the space with the filters 3, 4.

Figure 3:
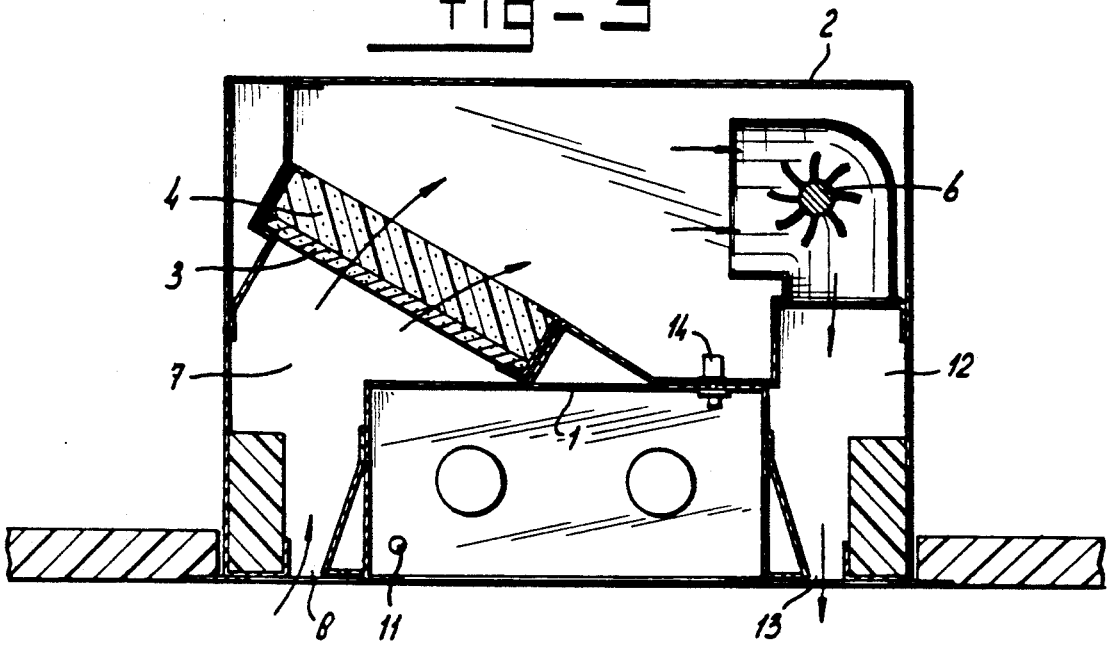
FIG. 3 shows a cross-sectional view of another embodiment of the present invention, ready for use.

FIG. 3 shows another embodiment of the present invention, wherein the electrical blower 6 is housed within the second hood 2. This blower 6 extends in lengthwise direction along the second hood 2. Also, the space between said first 1 and said second hood 2 defines an exhaust channel 12 extending from the filter device, to exhaust filtered air. This channel 12 ends at the exhaust opening 13, which extends in lengthwise direction along the first hood 1. The exhaust opening 13 is defined by a slit with varying width between the first 1 and the second hood 2. The filters 3, 4 are inclined relative to the horizontal, to increase the filtering surface. The first hood 1 is pivotably mounted at 11 within the second hood 2. Quick-lock fasteners 14 hold the first hood 1 in position.

Figure 4:
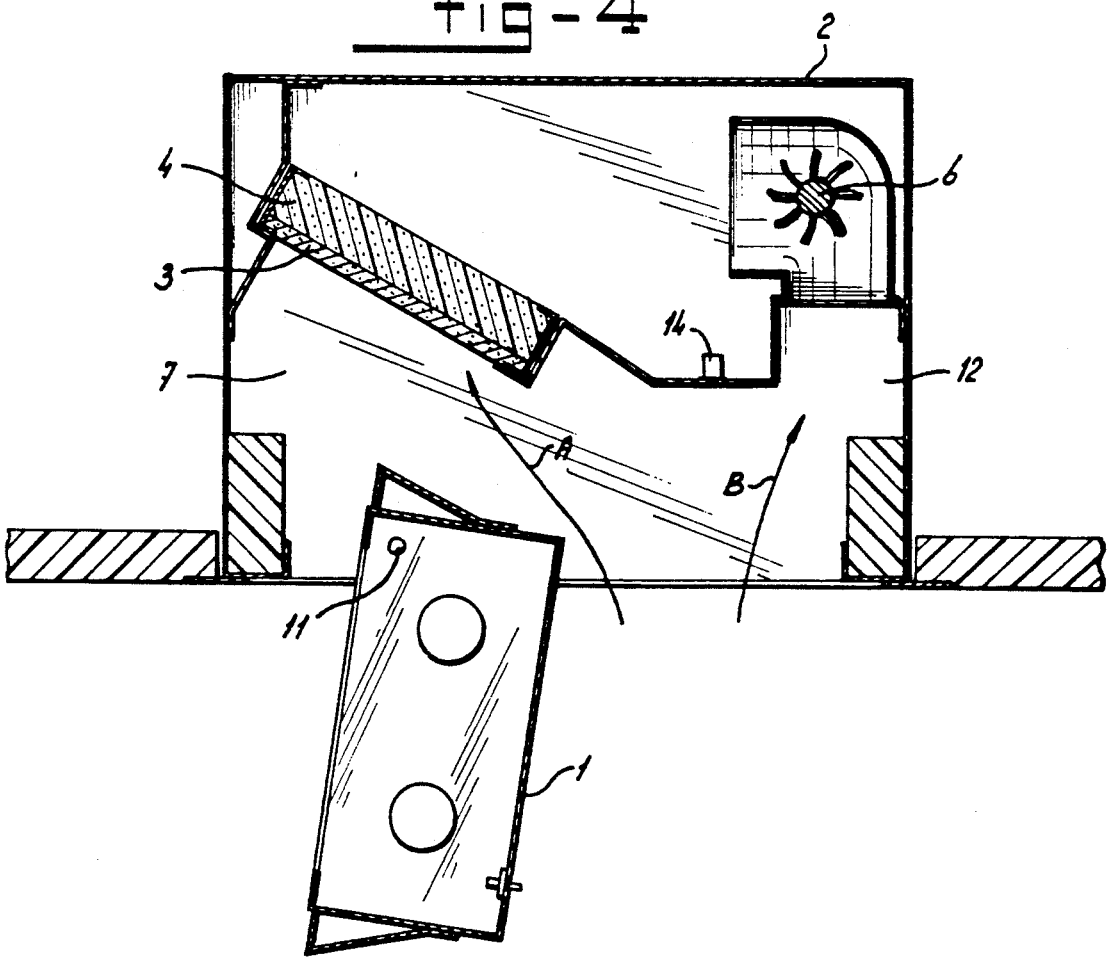
FIG. 4 shows in the same view the embodiment of FIG. 3 during maintenance.

FIG. 4 shows the embodiment of FIG. 3 in a maintenance situation, wherein the first hood 1 is pivoted around support 11. In this situation the filters 3, 4 and the electrical blower 6 are easily accessible in the direction of the arrow A and B respectivily.

It will be appreciated that several modifications are possible within the scope of the present invention. According to the invention, it is essential that a lighting-fitting for TL-tubes is combined with a filter device to remove smoke components cigars and cigarettes. Furthermore, assembling and disassembling of the first hood relative to the second hood must be convenient to obtain easy accessibility of the space with the filters and eventually the electrical blower, resulting in an efficient replaceability of the filter and the blower.

Because nowadays the shape of TL-tubes is not exclusively straight, but can also be e.g. annular or spherical, the shape of the lighting-fitting according to the present invention is not restricted to rectangular, but can also be e.g. square or round.

Subsequently, several combinations of shapes of smoke channel openings with type of filter and shape of filter and positions of suckout openings are possible to obtain an even suck-out of air from the room below the fitting.

We claim:

1. A lighting-fitting suited for integration into a ceiling which includes a number of spaced apart members for supporting sections of said ceiling, said lighting-fitting comprising:

a filter device for removing smoke components of cigars and cigarettes, said filter device including an electrical blower and at least one smoke filter;

a socket structure for an electrical lamp housed within a first hood, said socket structure receiving at least one relatively slender, tubelike electrical lamp;

a second hood in which said electrical blower and said at least one smoke filter are housed;

said second hood being larger than said first hood and having a lower edge;

said second hood being supported along said lower edge by said two ceiling support members;

a space between said first hood and said second hood forming a smoke channel having at least one feed opening and at least one exhaust opening and forming an exhaust channel extending from the filter device for exhausting filtered air;

said at least one feed opening, said at least one exhaust opening and said exhaust channel respectively extending in a lengthwise direction;

said at least one smoke filter being located within said second hood over the top of the first hood; and said first hood being pivotably movable relative to said second hood so as to facilitate access to said at least one smoke filter after pivoting said first hood out of said second hood.

2. The lighting-fitting in claim 1 wherein said at least one smoke filter is supported by spaced apart members attached to said second hood.

3. The lighting-fitting of claim 2 wherein said at least one smoke filter is supported substantially parallel to said ceiling.

4. The lighting-fitting of claim 2 wherein said at least one smoke filter is supported at an angle to said ceiling.

5. The lighting-fitting of claim 2 wherein said first hood has a lower edge which is in the same plane as the lower edge of said second hood and substantially the same plane as the ceiling.

6. A ceiling comprising a lighting-fitting and a plurality of ceiling support sections, said lighting-fitting being supported by said support sections of said ceiling and comprising:

a filter device for removing smoke components of cigars and cigarettes, said filter device including an electrical blower and at least one smoke filter;

a socket structure for an electrical lamp housed within a first hood, said socket structure receiving at least one relatively slender, tubelike electrical lamp;

a second hood in which said electrical blower and said at least one smoke filter are housed;

said second hood being larger than said first hood and having a lower edge;

said second hood being supported along said lower edge by said two ceiling support sections;

a space between said first hood and said second hood forming a smoke channel having at least one feed opening and at least one exhaust opening and forming an exhaust channel extending from the filter device for exhausting filtered air;

said at least one feed opening, said at least one exhaust opening and said exhaust channel respectively extending in a lengthwise direction;

said at least one smoke filter being located within said second hood over the top of the first hood; and said first hood being pivotably movable relative to said second hood so as to facilitate access to said at least one smoke filter after pivoting said first hood out of said second hood.

* * * * *